US008602680B2

(12) United States Patent
Fischer et al.

(10) Patent No.: US 8,602,680 B2
(45) Date of Patent: Dec. 10, 2013

(54) SOIL COMPACTING DEVICE WITH AUTOMATIC OR OPERATOR-INTUITIVE ADJUSTMENT OF THE ADVANCE VECTOR

(75) Inventors: Michael Fischer, Munich (DE); Otto W. Stenzel, Herrsching (DE); Oliver Kolmar, Neubiberg (DE); Martin Awrath, Munich (DE); Walter Unverdorben, Markt Indersdorf (DE); Hermann Schennach, Dietersheim (DE)

(73) Assignee: Wacker Neuson Produktion GmbH & Co., KG, Munich (DE)

( * ) Notice: Subject to any disclaimer, the term of this patent is extended or adjusted under 35 U.S.C. 154(b) by 816 days.

(21) Appl. No.: 11/993,118

(22) PCT Filed: Jun. 23, 2006

(86) PCT No.: PCT/EP2006/006088

§ 371 (c)(1),
(2), (4) Date: Aug. 23, 2010

(87) PCT Pub. No.: WO2006/136447

PCT Pub. Date: Dec. 28, 2006

(65) Prior Publication Data

US 2010/0303546 A1 Dec. 2, 2010

(30) Foreign Application Priority Data

Jun. 24, 2005 (DE) ..... 10 2005 029 432

(51) Int. Cl.
*E01C 23/07* (2006.01)
*E01C 19/30* (2006.01)
*E01C 19/32* (2006.01)

(52) U.S. Cl.
USPC ..... 404/133.1; 404/84.05; 404/133.05

(58) Field of Classification Search
USPC ..... 180/19.3; 404/133.05, 133.1, 133.2, 404/84.05, 84.1, 122
See application file for complete search history.

(56) References Cited

U.S. PATENT DOCUMENTS

| | | | | |
|---|---|---|---|---|
| 3,871,788 | A * | 3/1975 | Barsby | 404/117 |
| 4,590,909 | A * | 5/1986 | Heintz | 123/360 |
| 5,695,298 | A * | 12/1997 | Sandstrom | 404/72 |
| 6,435,767 | B1 * | 8/2002 | Steffen | 404/133.1 |
| 6,717,379 | B1 | 4/2004 | Andersson | |
| 6,722,815 | B2 * | 4/2004 | Fervers | 404/75 |
| RE38,632 | E * | 10/2004 | Schmidt et al. | 701/41 |

(Continued)

FOREIGN PATENT DOCUMENTS

| | | |
|---|---|---|
| DE | 19912813 C1 | 12/2000 |
| WO | 02/35005 A | 5/2002 |

*Primary Examiner* — Thomas B Will
*Assistant Examiner* — Abigail A Risic
(74) *Attorney, Agent, or Firm* — Boyle Fredrickson S.C.

(57) ABSTRACT

A vibrating plate comprises a vibration generator device, which can be controlled in such a manner that the direction of the action of force can be set at a number of locations, particularly in more than two locations. In addition, an advance adjusting device is provided for controlling the vibration generator device whereby the direction of the action of force is set in a position in which a maximum possible advance of the vibrating plate is reached. The direction of the action of force can be changed according to a change in the surroundings of the vibrating plate, particularly to the slope and/or the hardness of a subsoil to be compacted by a soil contact plate. Alternatively, the direction of the action of force can be changed according to the wishes of the operator.

12 Claims, 4 Drawing Sheets

(56) References Cited

U.S. PATENT DOCUMENTS

| | | | | |
|---|---|---|---|---|
| 6,808,336 | B2 * | 10/2004 | Fervers et al. | 404/117 |
| 6,846,128 | B2 * | 1/2005 | Sick | 404/133.05 |
| 7,117,758 | B2 * | 10/2006 | Riedl | 74/87 |
| 7,354,221 | B2 * | 4/2008 | Congdon | 404/84.1 |
| 7,740,091 | B2 * | 6/2010 | Bartel | 180/6.48 |
| 7,753,621 | B2 * | 7/2010 | Steffen | 404/133.1 |
| 8,123,432 | B1 * | 2/2012 | Steffen | 404/84.05 |
| 2003/0057000 | A1 * | 3/2003 | Fortin | 180/19.3 |
| 2003/0180093 | A1 * | 9/2003 | Fervers | 404/133.1 |
| 2004/0022582 | A1 * | 2/2004 | Sick | 404/133.05 |
| 2005/0193843 | A1 * | 9/2005 | Laugwitz | 74/87 |
| 2006/0053763 | A1 * | 3/2006 | Stover et al. | 56/16.7 |
| 2008/0247824 | A1 * | 10/2008 | Steffen | 404/133.05 |

* cited by examiner

SOIL COMPACTING DEVICE WITH AUTOMATIC OR OPERATOR-INTUITIVE ADJUSTMENT OF THE ADVANCE VECTOR

BACKGROUND OF THE INVENTION

1. Field of the Invention

The present invention relates to a vibrating plate according to the preamble of patent claim 1. Vibrating plates for soil compaction standardly have a lower mass that includes, inter alia, a soil contact plate that compacts the soil and a vibration exciter device that charges the soil contact plate, as well as an upper mass that is connected to the lower mass via a spring device; the drive, for example, being considered as part of the upper mass.

2. Description of the Related Art

Reversible vibration plates, i.e. vibration plates whose direction of travel can be switched at least between the forward and backward direction, are standardly realized in what is known as two-shaft technology. Such machines are either operable via remote control or are manually guided. In manually guided vibration plates, attached to the upper mass there is a guide drawbar on whose head there are provided elements for controlling the direction of travel. Using these travel direction control elements, inter alia the vibration exciter can be controlled so as to produce a vibration having a resultant force whose horizontal direction of action is oriented in the direction desired by the operator. Moreover, the travel direction control elements usually have a robust construction, so that the operator can also influence the direction of travel of the vibration plate through the manual introduction of force, or can even steer the vibration plate.

In vibrating plates that use two-shaft technology, the vibration exciter situated on the lower mass has two imbalance shafts that are capable of rotation in opposite directions. The imbalance shafts are coupled to one another with a positive fit so as to be capable of rotation, so that the front shaft rotates backward and the rear shaft rotates forward. The imbalance masses borne by the two shafts are rotated by 90° relative to one another in the initial position.

A vibrating plate of this type is known e.g. from WO 02/35005 A1.

FIG. 1 schematically shows a side view of a vibrating plate known from the prior art. On a soil contact plate 1, there is situated a vibration exciter formed from a front imbalance shaft 2 and a rear imbalance shaft 3. Via a spring device 4 made up of a plurality of springs, an upper mass 5 is connected to soil contact plate 1. In upper mass 5, there is provided a drive (not shown) for the vibration exciter. In addition, a drawbar 6 having an operating element 7 is attached to upper mass 5.

In the vibration exciter, on imbalance shafts 2, 3 there are attached imbalance masses 8 and 9 respectively, which in the initial position shown in FIG. 1 are rotated by 90° to one another. The opposite rotation of imbalance shafts 2, 3 gives rise to a resultant force vector 10 that at all times is inclined by 45° to the surface of the soil, i.e. the plane defined by soil contact plate 1. The impact of the lower mass, formed essentially by soil contact plate 1 and the vibration exciter, results in soil compaction. Of the nominally existing overall imbalance force, due to the angular setting about 70% is used for compaction (vertical force component) and for propulsion (horizontal force component) respectively.

One of the two imbalance masses 8, 9 can be rotated by up to 180° on the associated imbalance shaft 2, 3. Alternatively, it is also possible to modify the overall phase position between the two imbalance shafts 2, 3. This creates the possibility of forward and backward controlling, as well as vibration in place, in which there is then 100% compaction with no horizontal movement.

FIG. 2 shows, in analogy to FIG. 1, a schematic representation of the vibrating plate, the phase position of imbalance shaft 3 with imbalance mass 9 being modified by 180° relative to the position shown in FIG. 1. This gives rise to a resultant force vector 10 that is essentially directed toward the rear with an angle of 45° to soil contact plate 1, thus bringing about backward travel of the vibrating plate. The corresponding modification of the phase position in the vibration exciter was brought about in a known manner by actuating operating element 7, i.e., pulling back on operating element 7.

In order to modify the phase position between imbalance masses 8, 9, or imbalance shafts 2, 3, a turning sleeve is standardly used that is fashioned such that e.g. the imbalance mass that is to be adjusted is guided in the direction of the shaft along a spiral groove, thus moving through the corresponding angle of rotation. Instead of a turning sleeve, other adjustment elements are known, such as differential or planetary drive. This technology has long been known, so that a more detailed description is not necessary here.

For particular cases of application (e.g. travel on poorly compactable material such as sand, during asphalt work, or during paving vibration), the compaction effect is less important than is a rapid propulsion of the vibrating plate. In practice, in such cases one sometimes makes do by modifying the angle between imbalance masses 8, 9 on shafts 2, 3 in such a way that the resultant force vector 10 runs more flatly. In FIG. 3, as an example a relative position of imbalance masses 8, 9 is shown in which a resultant force vector 10 results whose angle of force action is less than 45°. Correspondingly, force vector 10 has a larger horizontal component, which achieves a stronger propulsion. Conversely, the vertical component of force vector 10 is reduced, so that the compaction effect is correspondingly less.

The flatter position of force vector 10 shown in FIG. 3 can take place e.g. by "re-hanging" imbalance shafts 2, 3 by one or more teeth on the 1:1 gear mechanism between imbalance shafts 2, 3. Another possibility is to use a turning sleeve that has a steeper inclination, causing an angular rotation of more than 180°.

If imbalance shafts 2, 3 are "re-hung" by one or more teeth, an enlargement of the horizontal component of the force vector can be achieved in only one direction, preferably the forward direction. In contrast, in the other direction the horizontal component is reduced, as can be seen in FIG. 4, in which imbalance shafts 2, 3, beginning from the position according to FIG. 3, are pivoted into rearward travel. Due to the large vertical portion of force vector 10 during rearward travel, the vibrating plate runs very roughly, making it impossible to use it on asphalt or for paving work.

In this case, a turning sleeve having a steep inclination of the guide groove is advantageous, which also enables a faster propulsion during rearward travel, corresponding to the propulsion in the forward direction, as is shown schematically in FIG. 5.

A disadvantage of both variants is that simultaneously with the vertical compaction force component, the force component that lifts soil contact plate 1 from the soil between the individual compacting strokes is also reduced. This is because the soil contact plate can spring from the soil being compacted and move forward in the desired manner only if there is a sufficiently large vertical force component. On flat ground, this is uncritical within large ranges of the angular position of force vector 10. However, when gradients in the soil have to be traveled over, the vertical force is often no longer sufficient to lift the lower mass up from the soil far enough to climb the gradient as a result of the forward-oriented horizontal force.

FIG. 6 shows such a case of application, in which a vibrating plate having a force vector 10 set flat (force action angle less than 45°) is climbing up a gradient. In this situation, there is a high probability that the vibrating plate will remain stationary even though the force component in the direction of movement (horizontal component relative to soil contact plate 1) was increased. This effect is often not comprehensible to the operator of the vibrating plate, and also hinders effective work.

OBJECT OF THE INVENTION

The present invention is based on the object of indicating a vibrating plate in which the propulsion speed can be optimized or maximized dependent on a modification of the environmental conditions or dependent on the operator's wishes. In addition, a method is indicated for a maximization of the propulsion speed of a vibrating plate.

According to the present invention, this object is achieved by a vibrating plate according to claim 1, 4, or 16, and by a method according to claim 17. Advantageous further developments are found in the dependent claims.

The vibrating plate according to the present invention is characterized in that a propulsion adjustment device is provided for controlling the vibration exciter device in such a way that the direction of the action of the force is always set to a position in which a maximum possible propulsion of the vibrating plate over the ground is achieved whenever the operator's control command demands a maximum propulsion speed. Here, the direction of the action of the force can be modified by controlling via the propulsion device, dependent on a modification of the surrounding environment of the vibrating plate, in particular the inclination and/or solidity of a terrain that is to be compacted by the soil contact plate.

With the aid of the propulsion adjustment device, it is thus possible to specify a suitable position for the vibration exciter device so that a force action direction results that is best suited to the respective case of application as determined by the environmental conditions (steepness, degree of compaction, solidity of the soil), and in particular such that a maximum propulsion speed is enabled whenever this is desired by the operator.

Surprisingly, it has turned out that the propulsion speed of a vibrating plate over stretches having different degrees of inclination depends to a considerable extent on the respective angle of the action of the force.

In travel over flat ground (gradient 0°), a force action angle between 20° and 30° results in a maximum propulsion speed. If the ground has a gradient of only 5°, in contrast, the optimal force action angle is about 40°, while if the ground has a gradient of 10° the force action angle must be around 60° in order to achieve a maximum propulsion speed.

Corresponding to expectations, as the gradient increases the maximum propulsion speed that can be achieved decreases. However, it is surprising that the optimal force action angle at which this maximum propulsion can be achieved moves toward larger angles as the gradient increases. Accordingly, on terrain having gradients it is not optimal to provide the vibrating plate with only a fixedly set force action angle (e.g. 45°). In that case, the best possible propulsion is not achieved, or the vibrating plate cannot climb gradients that are in fact capable of being climbed. Given a force action angle of 45° and a gradient of only 10°, the propulsion speed can go to zero.

However, with suitable actuation of the angular position of the imbalance shafts an optimal force action angle can be found for each of the various gradient angles, so that propulsion is always possible up to a certain limit value of the gradient of the terrain. Here a fixed allocation, stored in the vibrating plate, of the "longitudinal inclination of the machine" or "angle of inclination of the soil contact plate" and the "angle of the resultant force vector" are of particular practical importance, with the goal of achieving maximum propulsion speed if the operator desires this and has "communicated" this desire to the vibrating plate, e.g. via an operating element.

FIG. 7 shows the above-described vibrating plate having improved climbing behavior, in which the operator, through suitable controlling using operating element 7, achieves a force vector 10 whose force action angle is greater than 45°, in order to achieve propulsion despite the relatively steep gradient.

However, in practice it is difficult for the operator to actuate the available control elements in order to adapt or to vary the position of the force vector in such a way that a propulsion is still produced for various gradients, or that such propulsion is maximized in each case. As a rule, this task places excessive demands on the operator, who may be poorly trained and whose concentration tends to wane as the hours worked become longer.

The vibrating plate according to the present invention provides assistance here due to the fact that the propulsion adjustment device is able to set the force action direction in such a way that a maximum possible propulsion of the vibrating plate can be achieved whenever desired by the operator. Here, "maximum possible propulsion" is to be understood as meaning a propulsion, or propulsion speed, that can be achieved in the most favorable case by the vibrating plate under the given conditions (e.g. the gradient). The vibrating plate according to the present invention automatically introduces measures in order to achieve this maximum possible propulsion or to keep it constant, as long as the operator has given a corresponding control command via the operating element, and has thus expressed his desire for maximum propulsion.

Of course, it is also open to the operator to give control commands via the operating element that do not require a maximum propulsion of the vibrating plate. Depending on the design of the vibration exciter, the operator can also set force action angles that bring about a reduced propulsion speed, travel in the opposite direction, or a steering movement of the vibrating plate. To this extent, the operator still has available all possibilities for controlling the vibrating plate known from the prior art. However, whenever the operator expressly desires a maximum propulsion of the vibrating plate, the propulsion adjustment device will automatically introduce the corresponding measures and will always achieve the maximum possible propulsion speed independent of any change in the surrounding environment of the vibrating plate, such as a gradient of the terrain.

The operator can for, example communicate a desire that the vibrating plate should achieve the maximum possible propulsion speed by pressing the operating element (e.g. a lever) against a pressure point (e.g. a pressure switch), i.e. applying pressure sufficient to actuate the pressure point. If, on the other hand, the pressure point is not actuated by the operating element, the setting of the force action angle follows the standard (e.g. linear) relation between the position of the operating element and the resulting force action direction. The automatic setting of the force action direction such that the maximum possible propulsion speed is always achieved is then switched off.

Here it is particularly advantageous that the force action direction is capable of being modified by controlling using the propulsion adjustment device, dependent on a change in the surrounding environment of the vibrating plate, in particular the gradient and/or solidity of soil that is to be compacted by the soil contact plate.

Accordingly, it can be advantageous for the propulsion adjustment device to have an inclination recognition device for recognizing an angle of inclination of the soil contact plate relative to a horizontal, in order in this way to determine that the vibrating plate is being moved in the plane or on a gradient. In addition, the propulsion adjustment device has an adjustment device for setting an angle, called the force action angle, of the force action relative to the soil contact plate dependent on the angle of inclination of the soil contact plate. For this purpose, there can be stored in the propulsion adjustment device a table having corresponding data. Depending on the determined angle of inclination, and thus the determined gradient, the optimal force action angle for the vibration exciter device is specified at which the maximum propulsion effect results.

In another variant of the present invention, defined in claim 4, as in the prior art the force action direction is capable of being modified by controlling using a propulsion adjustment device dependent on a control command of the operator, it being possible for the operator to input the control command using an operating element. According to the present invention, in addition to the operating element the propulsion adjustment device also has another device for recognizing the operator's wishes. This means that, besides the usual evaluation of the position of the operating element (e.g. a handle, lever, sensor, joystick), a further evaluation is carried out in order to achieve an even better recognition of the operator's wishes. For this purpose, the device for recognizing the operator's wishes has at least one force measuring device with which a force applied by the operator to the operating element and/or to another operating element can be acquired in at least one spatial direction. If the force acquired by the force measurement device is greater than a force required for the normal actuation of the operating element, this is interpreted by the propulsion adjustment device as meaning that the operator is not satisfied with the effect that he has achieved by adjusting the operating element alone. Rather, the propulsion adjustment device then assumes that the operator desires a stronger effect.

If for example, the operator pushes an operating lever used as an operating element forward and continues to press it in the forward direction with increased force, the propulsion adjustment device interprets this behavior as meaning that the operator desires faster propulsion of the vibrating plate. Correspondingly, the propulsion adjustment device can introduce measures to increase the propulsion speed, to the extent that this is technically possible.

If the force acquired by the force measurement device is greater than a force required for the normal actuation of the operating element, the propulsion adjustment device modifies the force action direction in accordance with specified rules. In this way, the propulsion speed can be maximized by interpreting wishes of the operator that are not explicitly expressed by the operator via the actuation of the operating element. This makes it possible to acquire the operator's intuitive reactions that occur in particular when obstacles (gradients) are encountered, and therefrom to draw corresponding inferences relating to the vibrating plate and to carry out adjustments at the vibration exciter.

The force measurement device can be fashioned to acquire the force that the operator exerts on the operating element that is used to input the control commands. However, alternatively, vibrating plates are also known that have at least two operating elements, namely a first operating element (e.g. operating lever) for operator input of control commands and a second operating element (e.g. a handle) at which the operator can guide the vibrating plate by grasping and introducing force. In this way, it is possible for the operator on the one hand to communicate his control commands to the propulsion adjustment device via the first operating element (e.g. a joystick), and in addition to use the second operating element (the handle) to exercise a corrective influence on the movement of the vibrating plate. The force measurement device is then advantageously fashioned such that it also acquires forces acting on the second operating element and interprets them as desires on the part of the operator, so that the force action direction of the vibration exciter can thereupon be modified by the propulsion adjustment device in accordance with the specified rules.

Advantageously, the propulsion adjustment device has for this purpose a device for recognizing the operator's wishes that can include a force measurement device for acquiring a force applied to an operating element by the operator in at least one spatial direction.

Preferably, the force measurement device can separately acquire a plurality of forces applied by the operator in a plurality of spatial directions.

It has turned out that the operator will intuitively attempt, by pressing or pulling on an operating element that can be attached to the end of a drawbar or a guide bow, to "help" the vibration plate achieve a faster propulsion. Thus, by pushing or pulling on the operating element the operator attempts to influence the propulsion speed. When the vibrating plate encounters an obstacle, in particular in the form of a gradient, the operator will try to lift the front of the vibrating plate by pressing down on the operating element and thus on the end of the drawbar of the vibrating plate, in a manner similar to a baby carriage, in order to facilitate the climb. In contrast, during backward travel the operator will lift the end of the drawbar so that the vibrating plate can more easily overcome the obstacle.

In this context, the term "drawbar" is to be understood as referring not only to "true" drawbars, but also to guide bows or other guide devices that enable the operator to exert a guiding force on the vibrating plate.

However, the present invention is not limited to drawbar-guided vibrating plates, but can also be used with remotely controlled vibrating plates. Here as well, it is possible for the operator to influence the controlling of the vibrating plate by intuitive pressing or pulling on an operating element. Similar phenomena can be observed for example in players of computer games, who exert forces on a joystick that go well beyond the forces required to operate the joystick in accordance with its design.

Preferably, on the basis of the separately acquired forces the force measurement device can produce force signals that are to be processed separately, the propulsion adjustment device having a control device with which the force signals can be evaluated in such a way that the force direction of the vibration exciter is modified dependent on the magnitude and/or direction of the force that brings about a respective force signal. In this way, by exerting a corresponding force on the operating element the operator can achieve particular control reactions of the propulsion adjustment device that result in a desired setting of the vibration exciter.

The term "operating element" refers to control grips or handles via which the operator can manually introduce forces for guiding the vibration plate. Handles are standardly fixedly mounted grips that are used exclusively for grasping by the operator, while control grips are movable in order to specify control commands for the vibration exciter, while also being built robustly enough to permit the operator to pull or push on them with full force. In addition, control elements can be specified that are used only to specify control commands for the vibration exciter, but that are not used to receive larger mechanical forces from the operator.

Advantageously, the operating element or the control element is used to specify a forward and/or backward travel of the vibrating plate, the force effect direction being capable of being set by the vibration exciter device dependent on a signal from the operating element or from the control element corresponding to a horizontal force component in the forward or backward direction. The operating element or control element thus make it possible to control the vibrating plate forward and backward in a known manner.

In a particularly advantageous specific embodiment of the present invention, a force action angle can be set to a prespecified standard force action angle whenever a force applied to the operating element by the operator does not exceed a prespecified boundary value. In general, in the following "force action angle" is to be understood as referring to the angle between the force action direction (direction of action of the resultant force produced by the vibration exciter) and the soil contact plate, regarded as a reference plane. Accordingly, the force action angle can have a maximum value of 90°. Pivoting of the force action direction beyond 90° would lead back to smaller force action angles.

The standard force action angle, with correspondingly oriented horizontal component, is set whenever the operator uses the operating or control element to specify a signal corresponding to forward or backward travel.

In a particularly advantageous specific embodiment of the present invention, the propulsion adjustment device is fashioned such that when a mostly downward-directed force exerted on the operating element by the operator exceeds a prespecified boundary value and forward travel is selected, the force action angle is capable of being set steeper than the specified standard force action angle. This is true of the case described above in which the operator, upon encountering an obstacle or a gradient, will have the intuitive tendency to lift the front end of the soil contact plate by pressing down on the rear end of the drawbar in order to make it easier for the vibration plate to climb the gradient. The propulsion adjustment device according to the present invention recognizes this effort on the part of the operator and infers therefrom that there is a gradient that is to be overcome. Correspondingly, and taking into account the factors described above, the force angle is set to a steeper angle.

For another case of application, in which the operator essentially pulls up on the operating element during backward travel so that the force applied by the operator exceeds a specified boundary value, the force action angle is again set steeper. Here as well, the operator attempts to intuitively improve the climbing behavior of the vibration plate by pulling up on the drawbar during backward travel. The propulsion adjustment device supports this effort by setting the force action angle to be steeper.

The pivot angle adjustments or pivot angle modifications specified by the propulsion adjustment device can take place in a stepped manner or continuously, depending on the design of the vibration exciter. The degree by which the propulsion adjustment device changes the force action angle relative to the standard force action angle can be fixedly specified, a mechanical or electronic pre-programming being possible. It is also conceivable for the force action angle to be modified in a plurality of steps, each having smaller pivot angles. These possibilities also depend essentially on the capabilities of the vibration exciter.

If, in contrast, during forward travel of the vibration plate the operator pushes the operating element forward, in the forward direction, this is interpreted by the propulsion adjustment device as a desire on the part of the operator to travel faster. Correspondingly, the force action angle is set flatter, in particular flatter than the standard force action angle. This enables a force action to be achieved that was described above in connection with FIG. 3.

The same holds correspondingly for backward travel. If the operator polls the operating element towards the rear, in the backward direction, he desires an increase of the propulsion in the backward direction. Correspondingly, the propulsion adjustment device causes the force action angle to be set flatter, as is shown for example in FIG. 5.

It is particularly advantageous that the propulsion adjustment device is fashioned such that whenever a modified force action angle has already been set that is correspondingly steeper or flatter than the prespecified standard force action angle, this modified force action angle is held constant even when the force applied to the operating element by the operator no longer exceeds the specified boundary value. Correspondingly, it is sufficient for the operator to press the operating element forward only at the beginning of, for example, a desired rapid forward travel of the vibrating plate, so that the flatter force action angle results. This force action angle is maintained even when the operator is no longer exerting an increased force. The same holds, for example, during a longer period of travel up a gradient, where the steeper force action angle is likewise no longer modified.

It is particularly advantageous that if a force that is applied to the operating element by the operator, and that is opposed to the original force exceeding the specified boundary value, itself exceeds another specified boundary value, the force action angle is pivoted in the direction of the oppositely acting force by a specified pivot angle, in several steps or continuously. This relates to the case in which, for example, the operator at first desired rapid forward travel, so that a flat force action angle was set. If the now automatically set higher propulsion speed is too fast for the operator, he will automatically pull back on the operating element, in a direction opposite the forward direction, even if he is not yet explicitly controlling the vibration exciter via the control element. The pulling on the operating element is recognized by the propulsion adjustment device, so that a steeper force action angle is thereupon set again and the vibrating plate slows its forward travel. Depending on the design, here it is possible, if the operator maintains the backward pulling force for a longer period of time, to finally bring the vibrating plate to a standstill in the horizontal direction (force action angle 90°).

Finally, in a further development of the present invention it is also possible to bring about a complete change in the direction of travel if the operator exerts correspondingly long-lasting forces on the operating element.

As stated, the exceeding of a specified boundary value by the force that the operator applies in the corresponding direction can be taken as a criterion for the setting of the force action angle steeper or flatter. Alternatively, or in addition, it is also possible to calculate the mean force applied by the operator over a particular period of time in order to produce the corresponding effects in case of an increase, or holding constant, or reduction in the force. In particular, in this way a floating mean value can be determined using a suitable time window, so that when there is an increase in the mean operator force, or also a remaining constant or a reduction of the mean operator force, the above-described measures can be taken by the propulsion adjustment device.

In another variant of the present invention, indicated in claim 16, the propulsion adjustment device has a speed detection device for acquiring a current propulsion speed and/or for acquiring a change in the propulsion speed. In addition, an evaluation device is provided for comparing the current propulsion speed with the last-acquired propulsion speed and/or for evaluating the change in the propulsion speed, so that an increase or reduction in the propulsion speed of the vibrating plate can be determined. Finally, a variation device is provided for modifying the force action direction in a pivot direction in small angular steps or continuously, in such a way that when an increase in the propulsion speed is determined, a further modification of the force action direction in the same pivot direction is brought about, whereas if a reduction in the propulsion speed is determined, a modification of the force action direction in an opposite pivot direction is brought about.

In this way, an automatic maximization of the propulsion speed is possible. The propulsion adjustment device monitors the effects resulting from a change in the force action angle. If, after modification of the force action angle, an increase in the propulsion speed is determined, the propulsion adjustment device infers therefrom that a further modification of the force action angle in the same manner would bring about an additional increase in the propulsion speed. If, in contrast, the propulsion speed has reduced, the propulsion adjustment device pivots the force action direction in a corresponding manner, with the expectation of thereby achieving an increase in the propulsion speed.

In the method according to the present invention for maximizing the propulsion speed, the steps required for this are executed. During the travel of the vibration plate dependent on a desired direction specified by the operator, the current propulsion speed (or a change in the propulsion speed) is acquired. The propulsion speed is compared to the last-acquired propulsion speed, and an increase or a reduction of the propulsion speed is determined. The force action direction is modified in the same pivot direction as was done in a previous change if an increase in the propulsion speed was determined. If, in contrast, a reduction in the propulsion speed is determined, the modification of the force action direction takes place in the pivot direction opposite the previous pivot direction. These steps are constantly repeated in order to enable optimization of the propulsion speed.

The last-described automatic regulation for the optimization of the propulsion speed can also take place in combination with the above-described operator-intuitive controlling, or also with a standard controlling of a vibrating plate. For example, it is conceivable to provide a button via which, as needed, the operator can automatically demand the maximum propulsion speed using automatic controlling. The operator is then largely relieved of having to carry out measures himself.

These and additional features of the present invention are explained in more detail below on the basis of an example, with the aid of the accompanying Figures.

DETAILED DESCRIPTION OF THE PREFERRED EMBODIMENT

The vibrating plate according to the present invention corresponds in many parts to the vibrating plates known from the prior art and described above in connection with FIGS. 1 to 7. To this extent, reference is made to the above description.

The vibrating plate has a known vibration exciter device using two-shaft technology, or also having three-shaft or multi-shaft technology. It is also possible for one of the imbalance shafts 2, 3 to be axially divided, each axial part bearing its own imbalance mass whose relative position can be controlled individually. In a vibration exciter of this type, a yaw moment can be produced around the vertical axis of the vibrating plate, which enables the plate to be steered. In a three-shaft vibration exciter, one half of the imbalance mass that is attached at the front in the two-shaft exciter is moved toward the rear. Correspondingly, the force action vector in two-shaft and three-shaft exciters has the same characteristic. The present invention can therefore also be used in three-shaft or multi-shaft exciters. In the following, however, for the sake of simplicity reference is made only to two-shaft vibration exciters as described above on the basis of FIGS. 1 to 7.

The vibration exciter in the vibrating plate according to the present invention is fashioned such that the direction of the resultant force can not only be set, as is generally standard, to the two limit positions (for forward and backward travel), but can also be set to intermediate positions. It is ideal if the force action direction can be set to numerous intermediate positions in order to enable realization of a large number of force action angles.

Figure 1:
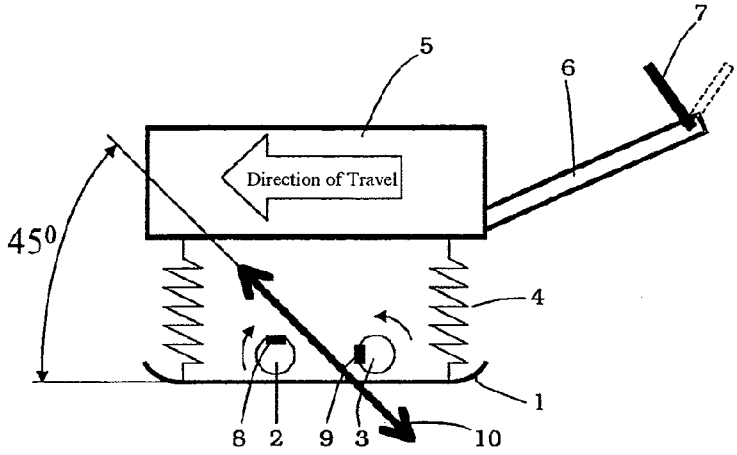
FIG. 1 shows a schematic side view of a vibrating plate known from the prior art in forward motion.
Figure 2:
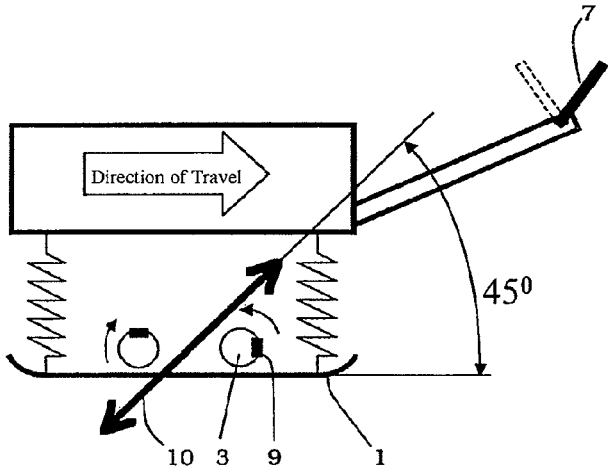
FIG. 2 shows the vibrating plate of FIG. 1 in backward motion.
Figure 3:
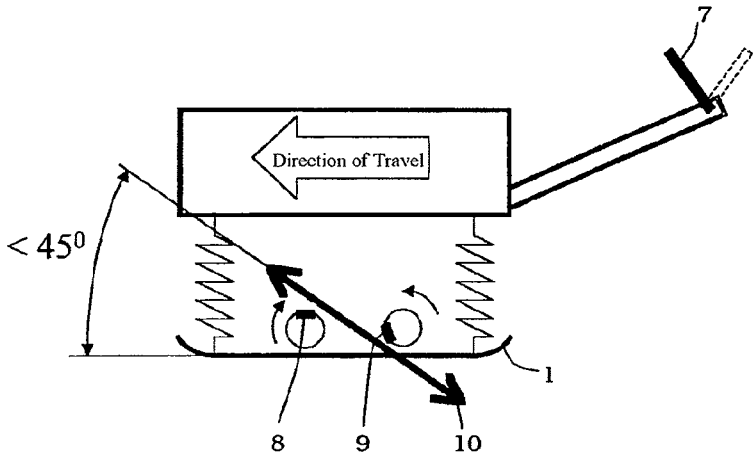
FIG. 3 shows the vibrating plate with increased forward motion.
Figure 4:
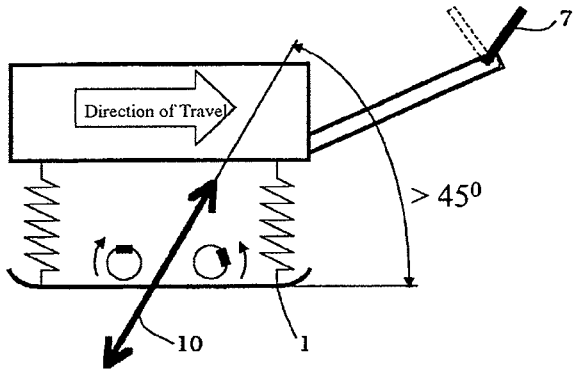
FIG. 4 shows the vibrating plate of FIG. 3 during backward travel.
Figure 5:
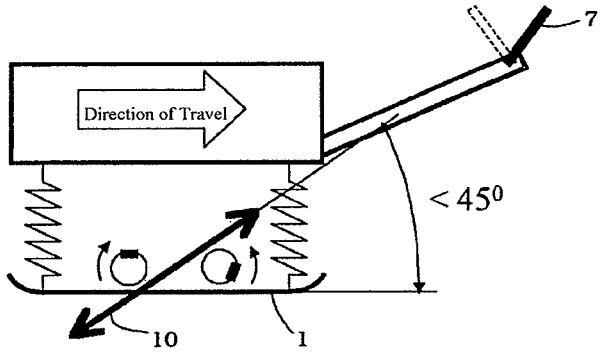
FIG. 5 shows the vibrating plate of FIG. 3 in a different specific embodiment, with increased backward travel.
Figure 6:
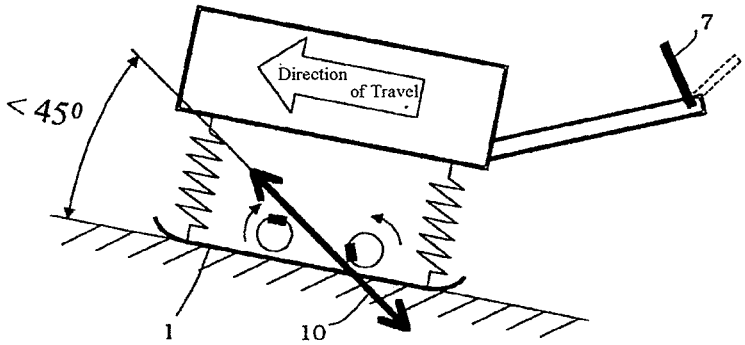
FIG. 6 shows the vibrating plate of FIG. 3 on a gradient.
Figure 7:
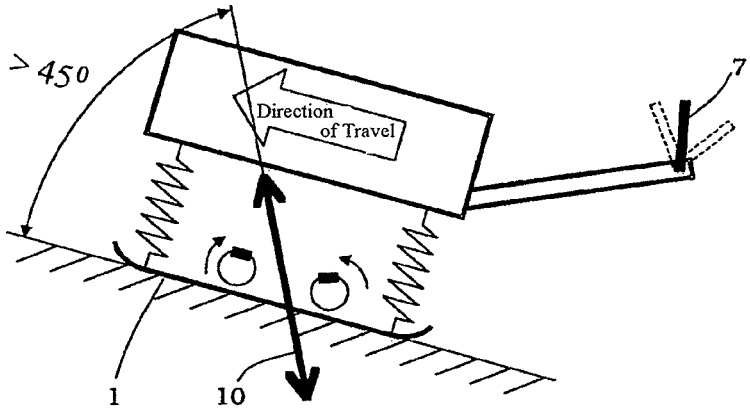
FIG. 7 shows a schematic representation of the vibrating plate of FIG. 6 with optimized climbing behavior.
Figure 8:
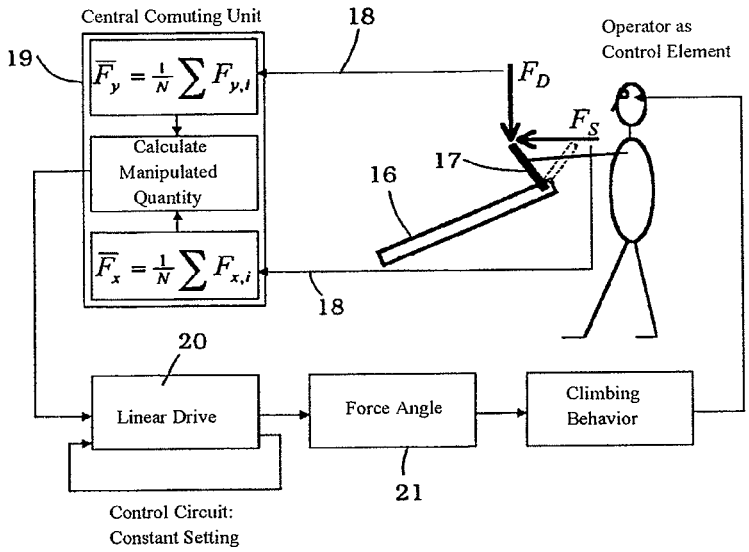
FIG. 8 shows a control circuit used in a vibrating plate according to the present invention for operator-intuitive controlling during forward travel.

FIG. 8 shows a schematic diagram of a control circuit with which an operator-intuitive optimization of the climbing behavior of the vibrating plate according to the present invention is achieved.

On a drawbar 16 fastened to an upper mass of the vibrating plate, an operating element 17 is provided via which the operator transmits control commands for forward and backward travel to the vibration exciter in a known manner. Operating element 17 can be constructed as a robust grip that can be pivoted between the forward position shown in FIG. 8 and a backward position shown in broken lines in FIG. 8. Moreover, via operating element 17 the operator can introduce mechanical forces for guiding and steering the vibrating plate.

In another specific embodiment (not shown), operating element 17 is a handle that is fixedly attached to drawbar 16. The control commands for the vibration exciter are then inputted by the operator via an additional control element (not shown).

Operating element 17 is coupled to a force measurement device (not shown) that measures the force applied by the operator. Here different spatial directions can be distinguished (upward, downward, toward the front, toward the rear).

The force measurement device produces force signals 18 that are communicated to a central computer 19. In central computer 19, from the measured operating forces a mean value is formed using a suitable time window (cf. FIG. 8, number N of measurement values whose mean value is to be formed in a floating manner).

On the basis of the forces thus acquired and differentiated with respect to their direction of action, an operator's desire is determined and is defined in the form of a manipulated variable for the vibration exciter. In the vibration exciter, for example a linear drive 20 can be provided that controls the imbalance masses or imbalance shafts in the desired manner in such a way that a specified force action angle 21 results.

Linear drive 20 should be capable of being adjusted continuously and of being held in the selected position in order to be able to achieve all intermediate angular positions. Linear drive 20 can be driven e.g. hydraulically or electromotorically. To linear drive 20 there can be connected a separate fast control circuit that has the task of holding constant the externally pre-selected relative position of the imbalance masses.

On the basis of the force action angle 21 and the vibration produced by the vibration exciter, there results a particular climbing behavior of the vibrating plate, which is noted in particular by the operator. To this extent, the operator acts as a control element. Depending on the operator's wishes, the operator will push or pull operating element 17, thereby bringing about, via the control circuit, a modification or a holding constant of force action angle 21, and thus of the climbing behavior of the vibrating plate.

If an operator wishes to cause the vibrating plate to travel faster, he will intuitively press forward on operating element 17 with more force (see FIG. 8, force $F_s$), although this will have hardly any effect in the case of larger plates due to their large, heavy mass. More forceful pressing (increase in the mean operator force) can be used as a command signal for central computer 19, in particular if force greater than a specified boundary value is applied, in order to adjust the imbalance masses in the vibration exciter incrementally relative to one another by a certain angular amount. In this way, the force action angle can be set flatter, so that a higher propulsion speed is achieved.

The operating forces on operating element 17 can be acquired by load cells on the drawbar head. It is also possible to provide pressure-sensitive handles. In principle, all types of pressure or force sensors capable of acquiring the manual force of the operator may be used. However, differentiation of various directions of action or spatial directions should be possible.

If central computer 19 receives the information (e.g. through evaluation of the floating mean value) that the mean value of the horizontal operator force $F_s$ has increased due to intuitive pressure on operating element 17, the force action angle is set flatter. This increases the forward speed in the plane. This functionality supports the operator above all when, on a flat surface, a larger surface area is to be covered via a higher speed. The maximum forward displacement that can be set of the overall force angle must be limited so that a vertical residual force remains that lifts the lower mass off the ground so that propulsion is still possible. Otherwise, contact plate 1 would no longer lift off the soil, and would merely execute a horizontal back-and-forth motion.

The maximum displacement of the force action angle that can usefully be set can be empirically determined and can be programmed into central computer 19 as a limiting item of information.

If the vibrating plate travels over uneven terrain or over a gradient, a second force measuring element will measure an operator force $F_D$ with which the operator will intuitively press vibrating plate down at drawbar 16 in order to lift the front edge of soil contact plate 1. Central computer 19 forms a suitable mean value for this force component as well. If central computer 19 obtains the information that the mean value of the downward vertical operator force has increased, or is greater than a prespecified boundary value, the force angle is set steeper. The resetting of the overall force vector must also have a maximum limit, in order to achieve a minimum necessary propulsion component.

If the machine is stuck on a gradient because the operator has set the force vector too steep, the operator will intuitively push the machine forward at operating element 17, causing the force action angle to be set flatter again. If the vertical downward-directed operator force decreases, the force angle will likewise be set flatter again. Both measures will enable the machine to resume travel.

As long as the vibrating plate is not receiving any horizontal or vertical operator force signal, it will reset the vibration exciter to a standard force angle of, e.g., 45°. For special applications (e.g. paving work), other standard force angles can also be specified.

Figure 9:
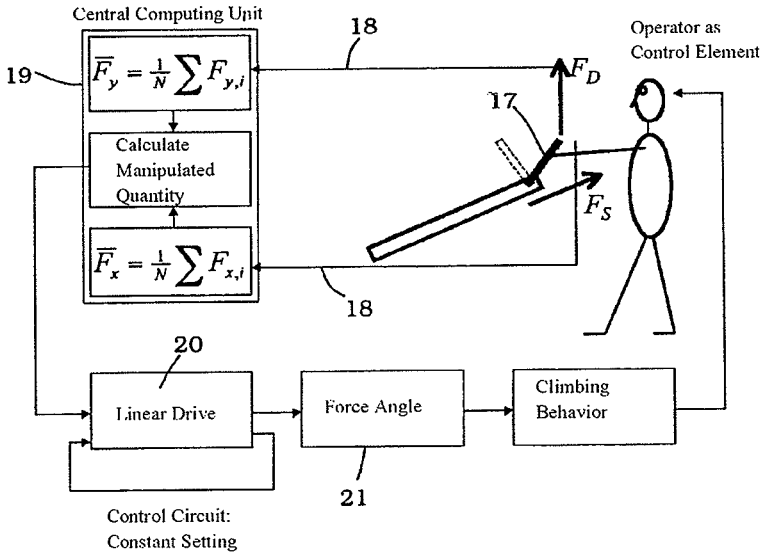
FIG. 9 shows a control circuit used in the vibrating plate according to the present invention for operator-intuitive controlling during backward travel.

FIG. 9 shows the control circuit of FIG. 8 during backward travel of the vibrating plate.

Operating element 17 was pivoted toward the rear by the operator in a known manner in order to control the vibration exciter in such a way as to produce a resultant force vector having a horizontal component in the backward direction.

Here as well, force measurement devices are again provided for acquiring the forces applied by the operator.

If during backward travel the vibrating plate moves onto a gradient, the operator will intuitively try to lift operating element 17, as an extension of drawbar 16, upward toward the rear in order to lift the rear edge of soil contact plate 1. The force $F_D$ applied for this purpose is acquired by the force measuring device and is forwarded as force signal 18 to central computer 19. If the measured operator force exceeds the normal operator force, this computer will set the force action angle to be steeper, so that a stronger lifting up of the lower mass with soil contact plate 1 is enabled.

If on the other hand the force action angle is set too steep, so that the propulsion speed of the vibrating plate is too low, the operator will intuitively try to pull the machine toward himself (force $F_s$). This force signal is also evaluated by central computer 19, whereupon the force action angle is again set to be flatter.

As long as a certain boundary gradient is not exceeded, it is thus possible to achieve a best possible travel speed for the vibrating plate even in the backward direction of travel. In principle, during backward travel the same control algorithm is used as during forward travel, except that the operator force quantities have the opposite sign (+ or −).

A suitable time constant can be built into the described control circuit of the vibrating plate in order to achieve a comfortable operating characteristic for the operator. Via a large number of measurement values N to be used for the floating mean value formation, the control circuit can be made sufficiently slow for human needs. The operator is then able to take over the role of a measurement element with respect to the climbing behavior of the vibrating plate, his intuitive operating behavior being actively supported by the vibrating plate. The desired slow reaction of the vibrating plate prevents the machine from behaving in a manner that would take the operator by, surprise.

The operating forces for initiating the described control mechanism must be greater than the operating forces that would normally be acting anyway. During normal operation the controlling of the machine will then feel subjectively familiar to the operator, and the operator will perceive the additional control possibilities resulting from the application of stronger operating forces as an additional control element.

Through intuitive, or also intentional, pushing and pulling on the operating elements, the operator can cause the vibrating plate to achieve a maximum propulsion speed both in the plane and also on a gradient. The additionally existing possibility of using operating element 17 to set intermediate positions of the vibration exciter, i.e. intentional force acting angles, is not affected by this. The vibrating plate according to the present invention provides the operator with a combination operating element with which he can control the vibrating plate intuitively in an optimal manner at all times.

In another specific embodiment of the present invention, in addition to the operator, or instead of the operator, as a measurement and actuating element a speed or acceleration sensor is provided with which the current forward speed or change in speed can be determined. Thus, the speed can also be determined for example through analysis of an acceleration measurement series. An automatic control element is thereupon able to vary the force action angle within prespecified limits, and to determine, through comparison with additional speed measurements, whether the variation in the force action angle, i.e. the pivoting of the force action angle, has taken place in the correct direction, so that the propulsion speed was increased. If, on the other hand, a reduction in the propulsion speed is determined, the force action angle can also be pivoted in the opposite direction.

Through the continuous comparison, the force action angle is set in such a way that an optimal propulsion speed can be achieved at all times.

The above-described intuitive operator controlling, or the last-described fully automatic force vector optimization, can be used independently of one another or also in combination with one another in the vibrating plate according to the present invention. It is also possible to use the two named principles in a propulsion adjustment device in which uphill or downhill travel of the vibrating plate is recognized, e.g. by a gradient recognition device, and a corresponding adjustment of the force vector is carried out.

The invention claimed is:

1. A vibrating plate, comprising:

an upper mass that has a drive; and a lower mass that is connected to the upper mass via a spring device and that has a vibration exciter device and a soil contact plate, the vibration exciter device being capable of producing a vibration having a resultant direction of force action, the vibration exciter device being capable of being controlled in such a way that the force action direction can be set to a plurality of positions, in particular more than two positions, an operating element being provided for operator inputting of a control command, the operating element being coupled to a propulsion adjustment device, so that the control command is capable of being transmitted to the propulsion adjustment device, and the force action direction being capable of being modified by controlling via the propulsion adjustment device, dependent on the operator's control command, wherein the propulsion adjustment device responds to the operator demanding a maximum propulsion speed by always adjusting the force action direction automatically, based on determined changes in at least one of the gradient and the solidity of the terrain that is to be compacted by the soil contact plate, to a position in which a maximum possible propulsion speed of the vibrating plate over the ground is maintained.

2. The vibrating plate as recited in claim 1, wherein the propulsion adjustment device has:

an inclination recognition device for recognizing an angle of inclination of the soil contact plate relative to a horizontal; and an adjustment device for setting an angle of the force action direction relative to the soil contact plate that is dependent on the angle of inclination of the soil contact plate.

3. The vibrating plate as recited in claim 2, wherein the angle of the force action direction that is to be set is an angle that ensures a greatest possible propulsion speed given the recognized angle of inclination.

4. The vibrating plate as recited in claim 1, wherein the vibrating plate has a drawbar on which at least one operating element is provided for guidance by the operator.

5. The vibrating plate as recited in claim 4, wherein the operating element or a control element is used to specify at least one of forward and backward travel of the vibrating plate, the force action direction being capable of being set with an appropriate horizontal force component in the forward or backward direction by the vibration exciter device dependent on a signal from the operating element or from the control element.

6. The vibrating plate as recited in claim 4, wherein, if a force applied to the operating element by the operator does not exceed a prespecified boundary value, a force action angle of the force action direction, relative to the soil contact plate regarded as a reference plane, can be set to a prespecified standard force action angle.

7. A vibrating plate, comprising:

an upper mass that has a drive;

a lower mass that is connected to the upper mass via a spring device and that has a vibration exciter device and a soil contact plate;

the vibration exciter device being capable of producing a vibration having a resultant direction of force action;

the vibration exciter device being capable of being controlled in such a way that the force action direction can be set to a plurality of positions, in particular more than two positions, an operating element being provided for operator inputting of a control command, the operating element being coupled to a propulsion adjustment device, so that the control command is capable of being transmitted to the propulsion adjustment device, and the force action direction being capable of being modified by controlling via the propulsion adjustment device, dependent on the operator's control command; wherein the propulsion adjustment device is fashioned in such a way that the force action direction is always set automatically to a position in which a maximum possible propulsion speed of the vibrating plate over the ground is achieved if the operator's control command demands a maximum propulsion speed; wherein the force action direction is capable of being modified by controlling via the propulsion adjustment device dependent on a change in at least one of the gradient and the solidity of the terrain that is to be compacted by the soil contact plate; wherein the vibrating plate has a drawbar on which at least one operating element is provided for guidance by the operator; and wherein the propulsion adjustment device is fashioned such that, when forward travel is selected and an essentially downward-directed force applied by the operator to the operating element exceeds a prespecified boundary value, or if the mean value of said force increases over a particular period of time, a force action angle of the force action direction, relative to the soil contact plate regarded as a reference plane, can be set steeper than a prespecified standard force action angle.

8. The vibrating plate as recited in claim 4, wherein, when backward travel is set and an essentially upward-directed force applied by the operator to the operating element exceeds a prespecified boundary value, or if the mean value of said force increases over a particular period of time, a force action angle of the force action direction, relative to the soil contact plate regarded as a reference plane, can be set steeper than a prespecified standard force action angle.

9. The vibrating plate as recited in claim 4, wherein, when forward travel is set and an essentially forward-directed force applied by the operator to the operating element in a forward direction exceeds a prespecified boundary value, or the mean value of said force increases over a particular period of time, a force action angle of the force action direction, relative to the soil contact plate regarded as a reference plane, can be flatter than a prespecified standard force action angle.

10. The vibrating plate as recited in claim 4, wherein, when backward travel is set and an essentially backward-directed force applied by the operator to the operating element in a backward direction exceeds a prespecified boundary value, or the mean value of said force increases over a particular period of time, a force action angle of the force action direction, relative to the soil contact plate regarded as a reference plane, can be set flatter than a prespecified standard force action angle.

11. The vibrating plate as recited in claim 4, wherein the propulsion adjustment device is fashioned such that, when a force action angle is set that is steeper or flatter than the standard force action angle, this force action angle can be held constant even if the force applied by the operator to the operating element no longer exceeds the prespecified boundary value, or if the mean value of said force no longer increases over a particular period of time.

12. The vibrating plate as recited in claim 4, wherein the propulsion adjustment device is fashioned such that, when a force that is applied by the operator to the operating element, and that acts opposite to the original force that exceeded the prespecified boundary value, itself exceeds another prespecified boundary value, or if the mean value of the oppositely acting force increases over a particular period of time, the force action angle in the direction of the oppositely acting force is pivoted by a prespecified pivot angle in several steps or continuously.

* * * * *